US007310408B2

(12) United States Patent
Filkins et al.

(10) Patent No.: US 7,310,408 B2
(45) Date of Patent: Dec. 18, 2007

(54) SYSTEM AND METHOD FOR X-RAY GENERATION BY INVERSE COMPTON SCATTERING

(75) Inventors: Robert John Filkins, Niskayuna, NY (US); John Scott Price, Niskayuna, NY (US); Brian Lee Lawrence, Clifton Park, NY (US); Matthew Christian Nielsen, Scotia, NY (US); Joseph John Manak, Albany, NY (US); Bruce Matthew Dunham, Mequon, WI (US)

(73) Assignee: General Electric Company, Niskayuna, NY (US)

( * ) Notice: Subject to any disclaimer, the term of this patent is extended or adjusted under 35 U.S.C. 154(b) by 377 days.

(21) Appl. No.: 11/096,488

(22) Filed: Mar. 31, 2005

(65) Prior Publication Data

US 2006/0222147 A1 Oct. 5, 2006

(51) Int. Cl.
*H05G 2/00* (2006.01)

(52) U.S. Cl. ..... 378/119

(58) Field of Classification Search ..... 378/119
See application file for complete search history.

(56) References Cited

U.S. PATENT DOCUMENTS

| | | | | |
|---|---|---|---|---|
| 3,813,555 | A * | 5/1974 | Viecelli | 372/5 |
| 3,822,410 | A * | 7/1974 | Madey | 372/2 |
| 3,886,366 | A * | 5/1975 | Kash | 378/119 |
| 4,598,415 | A * | 7/1986 | Luccio et al. | 378/119 |
| 5,274,689 | A * | 12/1993 | Palathingal et al. | 378/119 |
| 5,353,291 | A | 10/1994 | Sprangle et al. | 372/5 |
| 5,495,515 | A | 2/1996 | Imasaki | |
| 5,703,923 | A | 12/1997 | Bardash | 378/87 |
| 5,815,517 | A * | 9/1998 | Ikegami | 372/2 |
| 5,825,847 | A | 10/1998 | Ruth et al. | 378/119 |
| 5,887,008 | A * | 3/1999 | Ikegami | 372/5 |
| 5,892,810 | A | 4/1999 | Sprangle et al. | 378/119 |
| 6,226,354 | B1 * | 5/2001 | Mamine | 378/119 |
| 6,332,017 | B1 | 12/2001 | Carroll et al. | 378/119 |
| 6,333,966 | B1 * | 12/2001 | Schoen | 378/119 |
| 6,459,766 | B1 * | 10/2002 | Srinivasan-Rao | 378/119 |
| 6,594,335 | B2 | 7/2003 | Davidson | 378/43 |
| 6,687,333 | B2 | 2/2004 | Carroll et al. | 378/119 |

(Continued)

FOREIGN PATENT DOCUMENTS

| | | |
|---|---|---|
| EP | 1209956 | 5/2002 |

(Continued)

*Primary Examiner*—Allen C. Ho
(74) *Attorney, Agent, or Firm*—Ann M. Agosti; Patrick K. Patnode

(57) ABSTRACT

A system for generating a tunable X-ray pulse comprises a first electron beam source configured to direct a first electron pulse of predetermined energy and pulse length towards a first interaction zone, a laser beam source configured to direct a first photon pulse of predetermined energy and pulse length towards the first interaction zone to interact with the first electron pulse. The first interaction produces a substantially monochromatic second photon pulse of higher photon energy directed towards a second interaction zone, and a second electron beam source configured to direct a second electron pulse of predetermined energy and pulse length towards the second interaction zone so that the second interaction produces an X-ray pulse of predetermined energy and pulse length in a cascaded inverse Compton scattering (ICS) configuration.

24 Claims, 4 Drawing Sheets

U.S. PATENT DOCUMENTS

| | | | | |
|---|---|---|---|---|
| 6,724,782 | B2 | 4/2004 | Hartemann et al. | 372/5 |
| 7,016,470 | B2 * | 3/2006 | Lawrence et al. | 378/119 |
| 7,027,553 | B2 * | 4/2006 | Dunham et al. | 378/5 |
| 7,072,444 | B1 * | 7/2006 | Manak et al. | 378/119 |
| 2003/0185255 | A1 | 10/2003 | Ye et al. | 372/18 |
| 2005/0226383 | A1 * | 10/2005 | Rifkin et al. | 378/119 |

FOREIGN PATENT DOCUMENTS

| | | |
|---|---|---|
| EP | 0770257 | 12/2002 |
| WO | WO2006104956 | 10/2006 |

* cited by examiner

SYSTEM AND METHOD FOR X-RAY GENERATION BY INVERSE COMPTON SCATTERING

BACKGROUND

The invention relates generally to X-ray generation systems. The invention particularly relates to inverse Compton scattering X-ray generation systems.

Conventional X-ray sources generally rely on either Bremsstrahlung radiation or synchrotron radiation. In Bremsstrahlung radiation X-ray embodiments, radiation is produced when energetic electrons are decelerated by heavy solid targets made of dense, high-Z materials. For example, radiation in common medical diagnostic X-ray tubes is generally of relatively low power and comprises long pulses or a continuous wave radiation. Moreover, such radiation is randomly polarized, incoherent radiation with a broad range of energies that is not easily energy selectable or energy tunable. Where synchrotron radiation is desired, radiation is produced by ultrahigh energy electron beams passing through magnetic undulators or dipoles in a storage ring synchrotron source. The X-rays generated by the synchrotron source are generally broadband, incoherent, low energy, fixed polarization and untunable except by significant changes in undulator geometry or energy tune in a large accelerator. In addition, such sources require high energetic electron beams, which in turn require large and expensive facilities.

Delivery of hard, tunable, monochromatic X-rays in an area with geometry suitable and practical for rapid human imaging has been a long desired goal. The advantages of a tunable source of mono-energetic X-rays are well known in the medical diagnostic and non-destructive evaluation fields. A device to produce X-rays in a clinical setting should be relatively compact and capable of delivering energies that encompass the useful diagnostic imaging range. If narrow bandwidth X-rays can be tuned, one can use quite different energies for monochromatic mammography versus chest or skull imaging. By using only the frequencies best suited to the examination being performed on a patient, one eliminates a significant portion of the radiation dose delivered to that person.

Few physical processes lend themselves to production of such beams as well as the phenomenon of Inverse Compton Scattering (ICS). ICS has been successfully used to generate X-rays by using linear accelerators and large, high-powered lasers. ICS based X-ray sources, due to their coherence and spectral properties, offer significant benefits in lower dosage, higher-contrast, and better resolution over conventional X-ray tube imaging technologies.

Although tunable, mono-energetic inverse Compton scattering X-ray systems sources have been constructed and demonstrated, the major drawback to these systems is their overall size, often encompassing several large rooms. Previous designs have attempted to shrink the size of the linear accelerator section by increasing the field gradients. This is achieved by increasing the operating frequency of the linear accelerator to the high gigahertz regime. While such designs work in theory, they do not reduce to practice easily due to reliability issues associated with the very high electric fields.

Therefore there is a need for a compact, tunable, monoenergetic ICS based X-ray source.

BRIEF DESCRIPTION

Briefly, in accordance with one embodiment, an inverse Compton scattering system for generating an X-ray pulse comprises a first electron beam source configured to direct a first electron pulse of predetermined energy and pulse length towards a first interaction zone, a laser beam source configured to direct a first photon pulse of predetermined energy and pulse length towards the first interaction zone to interact with the first electron pulse, so that the first interaction produces a substantially monochromatic second photon pulse of higher photon energy directed towards a second interaction zone, and a second electron beam source configured to direct a second electron pulse of predetermined energy and pulse length towards the second interaction zone so that the second interaction produces an X-ray pulse of predetermined energy and pulse length in a cascaded inverse Compton scattering (ICS) configuration.

In accordance with another embodiment an imaging system comprises a first electron beam source of the imaging system configured to direct a first electron pulse of predetermined energy and pulse length towards a first interaction zone, a laser beam source configured to direct a first photon pulse of predetermined energy and pulse length towards the first interaction zone to interact with the first electron pulse so that the interaction produces a substantially monochromatic second photon pulse of higher photon energy directed towards a second interaction zone, and a second electron beam source of the imaging system configured to direct a second electron pulse of predetermined energy and pulse length towards the second interaction zone so that the interaction produces a tunable, substantially monochromatic X-ray pulse of predetermined energy and length in a cascaded inverse Compton scattering (ICS) configuration.

In accordance with still another embodiment, a method of generating an X-ray pulse of tunable energy comprising the steps of generating a first photon pulse, generating a first electron pulse substantially synchronously with the first photon pulse, inverse Compton scattering the first photon pulse off the first electron pulse in a first interaction zone to produce a second photon pulse, wherein the photons in the second photon pulse have a higher energy than the photons in the first photon pulse, generating a second electron pulse, and inverse Compton scattering the second electron pulse with the second photon pulse in a second interaction zone to produce a pulse of tunable substantially monochromatic X-ray photons.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Inverse Compton scattering is a method for producing mono-energetic and tunable X-rays. In the inverse Compton scattering (ICS) process, X-rays are produced by the particle-particle collision of a relativistic electron with a relatively low energy photon, typically an infrared photon. Typically, the photons in an optical pulse impact head-on or nearly head-on with relativistic electrons in an electron beam, which have more kinetic energy than the photons in the optical pulse. As a result of the collision, the photon extracts energy from the fast moving electron and is essentially Doppler-shifted to create a higher energy photon. In particular, the scattered photons gain energy and are shorter in wavelength than the incident photons, while the outgoing electron beam has lower kinetic energy than the incident electron beam. The X-rays emitted via the process of ICS as described hereinabove, are pulsed, tunable, and substantially monochromatic.

Figure 1:
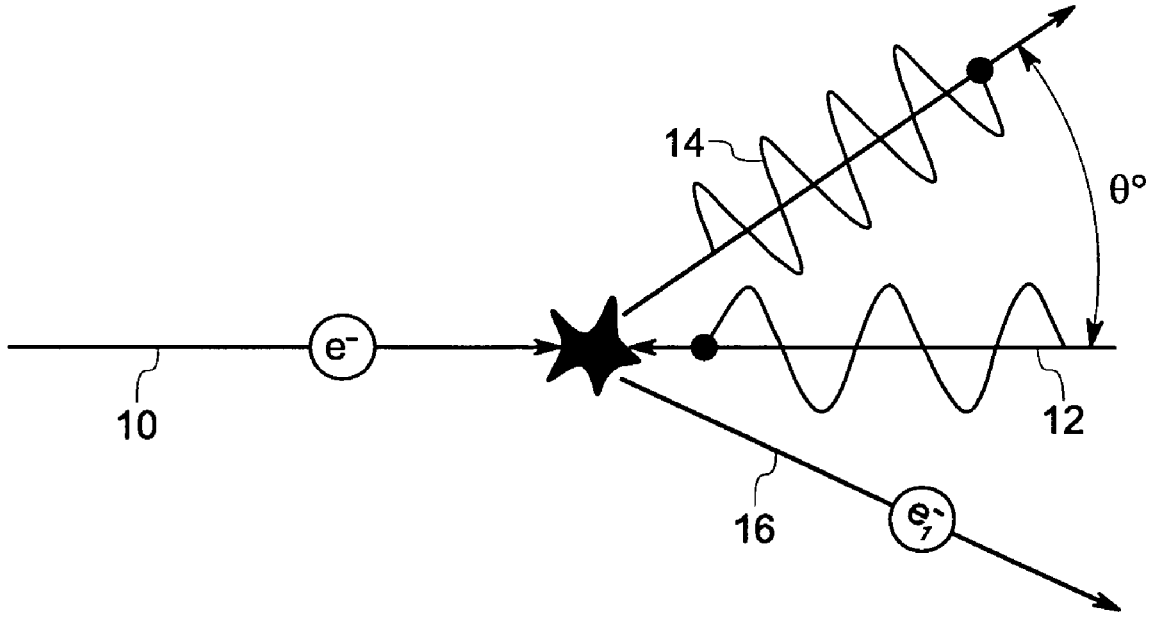
FIG. 1 is a schematic representation of inverse Compton scattering.

Referring to FIG. 1, when a relativistic electron 10 with an energy $E_e$ interacts with a counter-propagating incident photon 12 of wavelength $\lambda$ and energy $E_\lambda$, where $E_e >> E_\lambda$, the wavelength $\lambda_{ICS}$ of the inverse Compton scattered photon 14 scattered at an angle $\theta$ from the direction of the incident beam and Doppler shifted in energy is approximately given by $$\lambda_{ICS} \cong \lambda/2(1+\cos(\theta))\gamma^2 \tag{1}$$

where $\gamma$ is the relativistic factor of the electron given by $$\gamma^2 = \left(1 - \frac{v^2}{c^2}\right)^{-1} = \frac{E_e^2}{(m_0c^2)^2}, \tag{2}$$

where $v$ is the speed of the electron, $m_o$ is the rest mass of the electron, and c is the speed of light. The scattered electron 16 is lower in energy than the incident electron 10.

If the scattering angle can be approximated to zero, then the wavelength of the scattered photon is given by $$\lambda_{ICS} \cong \lambda_0/4\,\gamma^2, \tag{3}$$

$$\lambda_{ICS} \cong \lambda_0(m_0c^2)^2/4E_e^2. \tag{4}$$

The wavelength of the scattered photon in angstroms is given by $$\lambda_{ICS}[A^\circ] \cong 6.5\cdot 10^2 \lambda_0[\mu m]/E_e^2[\mathrm{MeV}]. \tag{5}$$

Therefore the energy of the scattered photon in keV is given by $$E_{ICS}[\mathrm{keV}] \cong 1.9\cdot 10^{-2} E_e^2[\mathrm{MeV}]/\lambda_0[\mu\mathrm{m}]. \tag{6}$$

When an inverse Compton scattered photon with an energy $E_{ICS}$ is further inverse Compton scattered off an electron with an energy $E'_e$, the scattered photon has an energy given by $$E'_{ICS}[\mathrm{keV}] \cong 1.9\cdot E_e^2[\mathrm{MeV}]\cdot E'^2_e[\mathrm{MeV}]/6.5\cdot\lambda_0[\mu\mathrm{m}] \tag{7}$$

One embodiment of the present invention is a cascaded inverse Compton scattering (ICS) X-ray generation system, where two or more inverse Compton scattering subsystems are cascaded or arranged in a configuration such that an inverse Compton scattered photon generated in a first ICS subsystem may be further inverse Compton scattered in a second ICS subsystem and so on. In the cascaded ICS arrangement, electrons from relatively low energy electron sources may be used to successively increase the energy of the photons.

Figure 2:
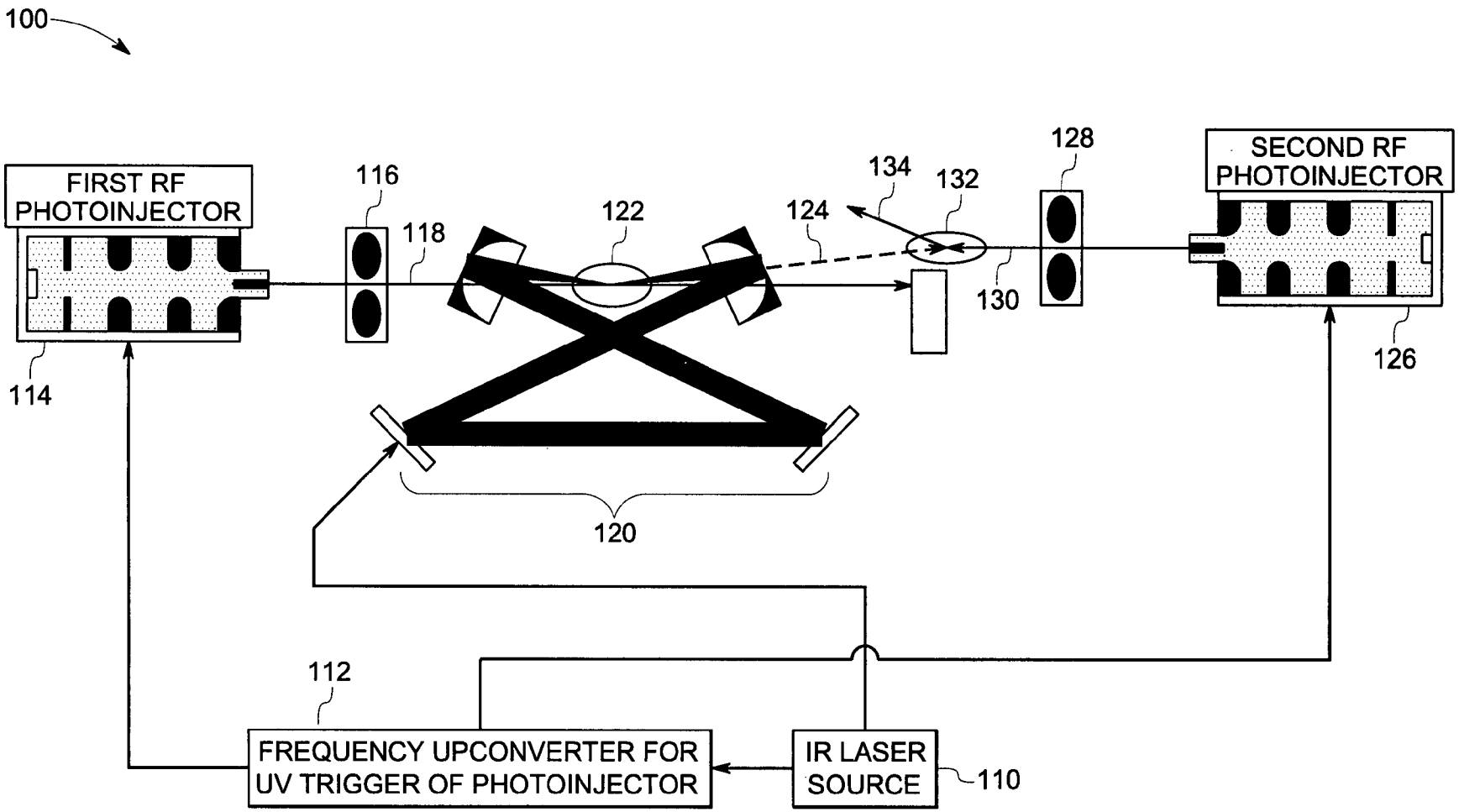
FIG. 2 is a schematic representation of one embodiment of an X-ray generation system of the present invention.

Referring now to FIG. 2, another embodiment is an X-ray generation system 100 for generating X-rays in a two-step scattering process. In this embodiment, a first electron beam source 114 emits electrons, and an electron focusing element 116 focuses the electron beam 118 towards the interaction zone 122, where the electrons interact with photons emitted by a laser source 110. In this first scattering step, the photons are Doppler shifted due to ICS to produce higher energy photons 124, typically extreme ultraviolet or soft X-ray photons with wavelengths on the order of a few nanometers. These higher energy photons 124 are then directed towards a second interaction zone 130 where they collide with a second electron beam 128 from a second electron beam source 126. In this second scattering step, the photons are further Doppler shifted into the hard X-ray regime, typically with wavelengths on the order of about 1 nm or less. In one embodiment, the energy and pulse length of the first electron pulse 118, second electron pulse, and first photon pulse are predetermined, wherein the running parameters of the laser source and electron beam source are so selected to determine the associated energies and pulse lengths. In a further embodiment, the pulse properties, such energy and pulse length, of the first electron pulse, second electron pulse, and the first photon pulse are individually configured and independently tuned. The energy of the X-ray pulse 134 can be desirably tuned by varying the energy of at least one of the first photon pulse, first electron pulse and second electron pulse.

In one embodiment of the present invention, the X-ray pulse generated by the X-ray generation system is substantially monochromatic. As defined herein, the term "substantially monochromatic" refers to a pulse having a fractional bandwidth of less than or equal to about 10% wherein "fractional bandwidth is defined as being the frequency bandwidth $\Delta f$ divided by the mean frequency f. In a more specific embodiment the fractional bandwidth of the X-ray pulse generated is less than or equal to about 5%. In a still more specific embodiment, the fractional bandwidth of the generated x-ray pulse is less than or equal to about 1%.

A non-limiting example of an electron beam source 114, 126, is an RF driven photoinjector. An RF driven photoinjector typically has a photocathode, which emits electrons when photons typically from a laser source 110, are incident on it. The RF photoinjector also has an accelerating structure or cavity driven by an RF source operating typically in the gigahertz regime, which establishes an accelerating field to accelerate the electrons to a desired energy, typically a few MeV. In one aspect of the present invention, the RF driven photoinjector is a normal conducting RF photoinjector having a normal accelerating structure or cavity. In another aspect of the present invention, the RF driven photoinjector is a superconducting RF photoinjector with a superconducting accelerating structure or cavity.

In another embodiment, the electron emission from the photoinjector is initiated when photons from a laser source 110 are upconverted to higher energy photons using a frequency upconverter 112 and are incident on the photocathode to trigger the emission of electrons. In a more specific embodiment, the laser source is a pulsed mode-locked laser.

In another embodiment, the X-ray generation system comprises an optical resonator 120 comprising the first interaction region and pumped by the laser source 110. The optical resonator 120 helps build up an intense pulse for interaction with the electrons. In a further embodiment the optical resonator is enclosed in a vacuum chamber.

Non-limiting examples of laser sources include Nd:YAG, Yb:YAG, Ho:YAG, Ti:Sapphire, Er:glass, Er:YAG, and Cr:Forsterite lasers. A frequency upconverter is typically a frequency doubler, tripler or quadrupler, wherein higher energy photons are produced through a non-linear optical process such as harmonic generation. In one example, the infrared (IR) radiation emitted by the laser source is converted into UV by a frequency upconverter. In one embodiment, the laser beam source is located remotely with respect to the first interaction zone and the second interaction zone. As used herein, the term "remotely" refers to a location outside of the immediate vicinity of the referenced zone. In one embodiment, the laser beam source is located remotely at a distance from wherein the output of the laser beam source is brought to the interaction zone via an optical conduit.

In a further embodiment, the energy of the electrons emitted by the RF photoinjector is tunable. The electron energy is typically tuned by varying the frequency of the RF source. In one embodiment, the first and second photoinjectors are photoinitiated by the same laser source. In another embodiment, the laser beam source comprises a first laser beam source and further comprises at least one additional laser beam source, wherein the first RF photoinjector source and second RF injector source are configured for being photointiated by an output of the at least one additional laser beam source.

Figure 3:
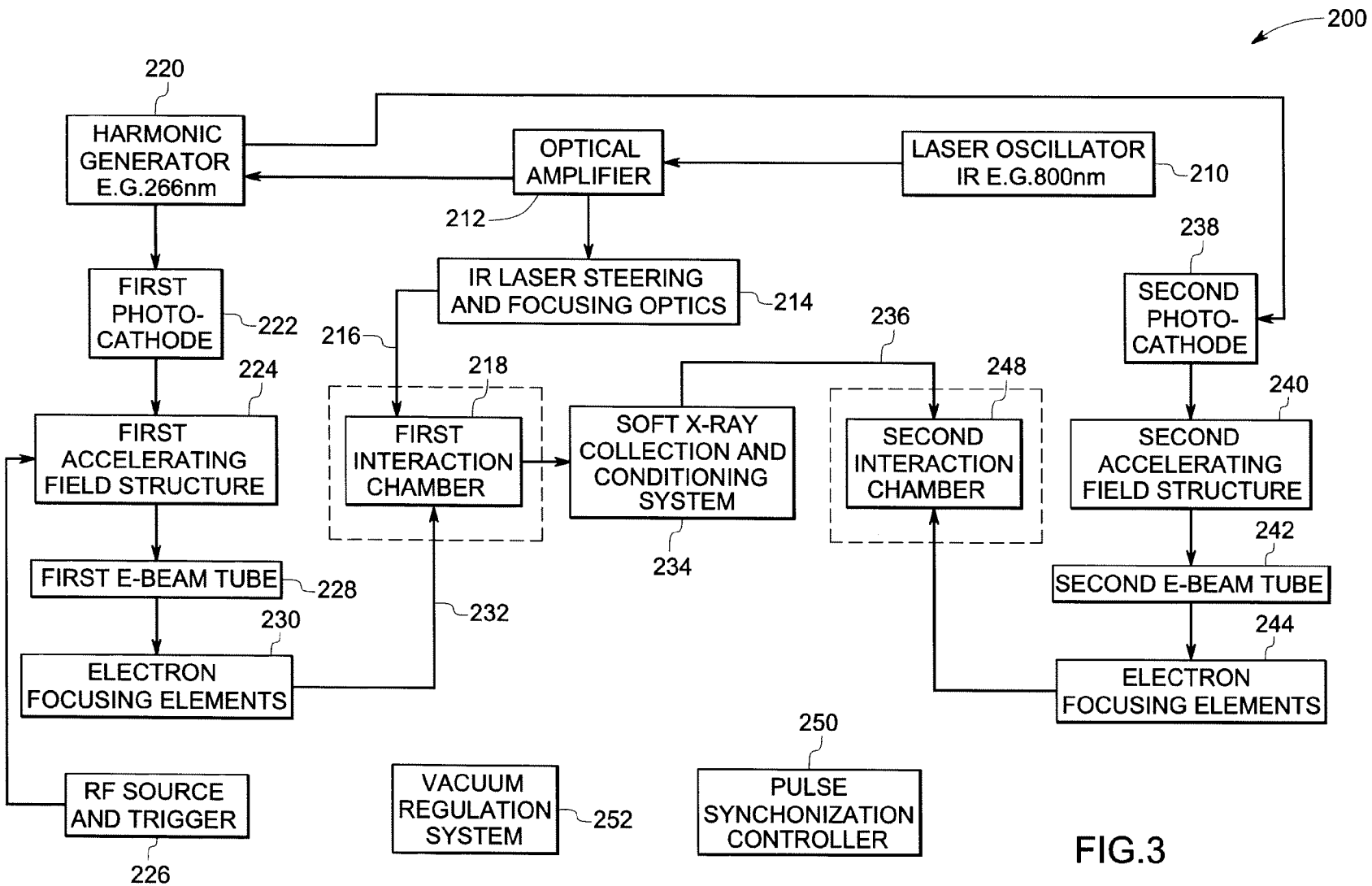
FIG. 3 is a schematic representation of another embodiment of an X-ray generation system of the present invention.

In a more specific embodiment, as illustrated in FIG. 3, optical amplifier 212 amplifies the output of a laser beam source (shown as laser oscillator 210) which typically emits at IR frequencies. A first part of the output of the amplifier is steered and focused using focusing and steering optics 214 into a first interaction zone (shown as first interaction chamber 218). A second part of the optical amplifier output pumps a harmonic generator 220 which frequency upconverts the input radiation and outputs the radiation typically in the UV region of the optical spectrum. The upcoverted beam is incident on a first electron beam source (shown as comprising a first photocathode 222 and a first accelerating field structure 224) and triggers the emission of electrons by the photocathode 222. Accelerating field structure 224 is driven by an RF source and trigger 226, and accelerates the electron to a desired energy. The accelerated electrons move through a first e-beam tube 228 and are steered and focused using electron focusing elements 230 into the first interaction chamber 218. The photon pulse 216 and the electron pulse 232 interact in the first interaction chamber 218, and the inverse Compton scattered photons are collected and conditioned by soft X-ray collection and conditioning system 234 to form the second photon pulse 236 which is steered into the second interaction chamber 248. A second photocathode 238, typically also triggered by the output of the harmonic generator 220, emits electrons that are accelerated through a second accelerating structure 240. The electron pulse is carried through an e-beam tube 242, and focused using electron focusing elements 244, and coupled into the second interaction chamber 248. The photons in the second photon pulse are inverse Compton scattered in the interaction chamber 248 resulting in hard X-rays. Pulse synchronization controller 250 synchronizes the electron and photon pulses to produce desired interactions leading to the production of X-rays. A vacuum regulation system 252 maintains desired vacuum levels in the X-ray generation system 200, especially in the first and second interaction chambers 218, 248.

In one embodiment, the pulse synchronization controller is configured for temporally synchronizing the first electron pulse, the second electron pulse and the first photon pulse. Synchronization desirably enables the interaction of the pulses such that first electron pulse interacts with the first photon pulse in a first interaction zone and such that the inverse Compton scattered pulse of photons (the second photon pulse) interacts with the second electron pulse in a second interaction zone. The synchronization controller also may enable the RF trigger pulse to initiate photoemission from the photocathode. One means of synchronization comprises a synchronization beam generated by the laser beam source, the synchronization beam transmitted concurrently with the laser beam and transmitted to the electron beam source to thereby trigger simultaneous generation of the electron pulse.

Energy of the electrons in the X-ray pulse is typically emitted is in a range of about 10 keV to about 50 keV, and the predetermined length of the X-ray pulse is typically in a range of about 10 fs to about 300 ps. In a more specific example, the predetermined length of the X-ray pulse is in a range of about 2 fs to about 10 ps. In another example, the X-ray pulse has a flux density of about $10^6$ photons/pulse to about $10^{16}$ photons/pulse. Typically the initial spot size of the X-ray pulse generated is in the range of about 25 microns to about 100 microns at the interaction point. In one embodiment the X-ray pulse generated is quasi coherent. In another embodiment, the X-ray generation system is a tube like structure.

A method of generating an X-ray pulse of tunable energy comprises the steps of generating a first photon pulse and generating a first electron pulse substantially synchronously with the first photon pulse to inverse Compton scatter the first electron pulse off the first electron pulse in a first interaction zone. As used herein, the term substantially synchronously refers to generating the first electron pulse and the first photon pulse at time instants facilitating their interaction at the first interaction zone. The method further comprises the step of producing a second photon pulse due to the interaction, wherein the photons in the second photon pulse have a higher energy than the photons in the first photon pulse and inverse Compton scattering the second electron pulse with the second photon pulse in a second interaction zone, wherein the collision of electrons in the second electron pulse with the photons in the second photon pulse produces a pulse of substantially monochromatic X-ray photons. In one embodiment the first photon pulse and first electron pulse collide substantially collinearly. The term substantially collinearly means the angle subtended by the incoming photon and the outgoing photon is plus or minus 10 degrees. In a further embodiment the second photon pulse and second electron pulse collide substantially collinearly.

The X-rays generated via the process of cascaded ICS as described in the various embodiments discussed above have a substantially monochromatic spectral nature as opposed to the broad energy distribution of traditional Bremsstrahlung processes and have quasi-coherent characteristics. These features offer significant benefits in a number of applications, such as to the medical imaging community including lower dosage, improved contrast, improved resolution, material or tissue type discrimination and new types of diagnostic imaging. As is further described below, one embodiment is an imaging system for generating an image comprising an X-ray system. In one embodiment, the imaging system comprises a computerized tomography (CT) system. In a further aspect of the CT embodiment, the imaging system comprises a rotary unit called the gantry configured to rotate integrally around an person object to be imaged, wherein at least the second interaction zone is situated within the gantry. The gantry further comprises an X-ray detector for detecting the X-rays. In a further aspect of the CT embodiment, the laser beam source is located remotely with respect to the rotary unit. An optical scanning system can be desirably used to guide the laser beam from the remote laser source into the rotary unit.

Figure 4:
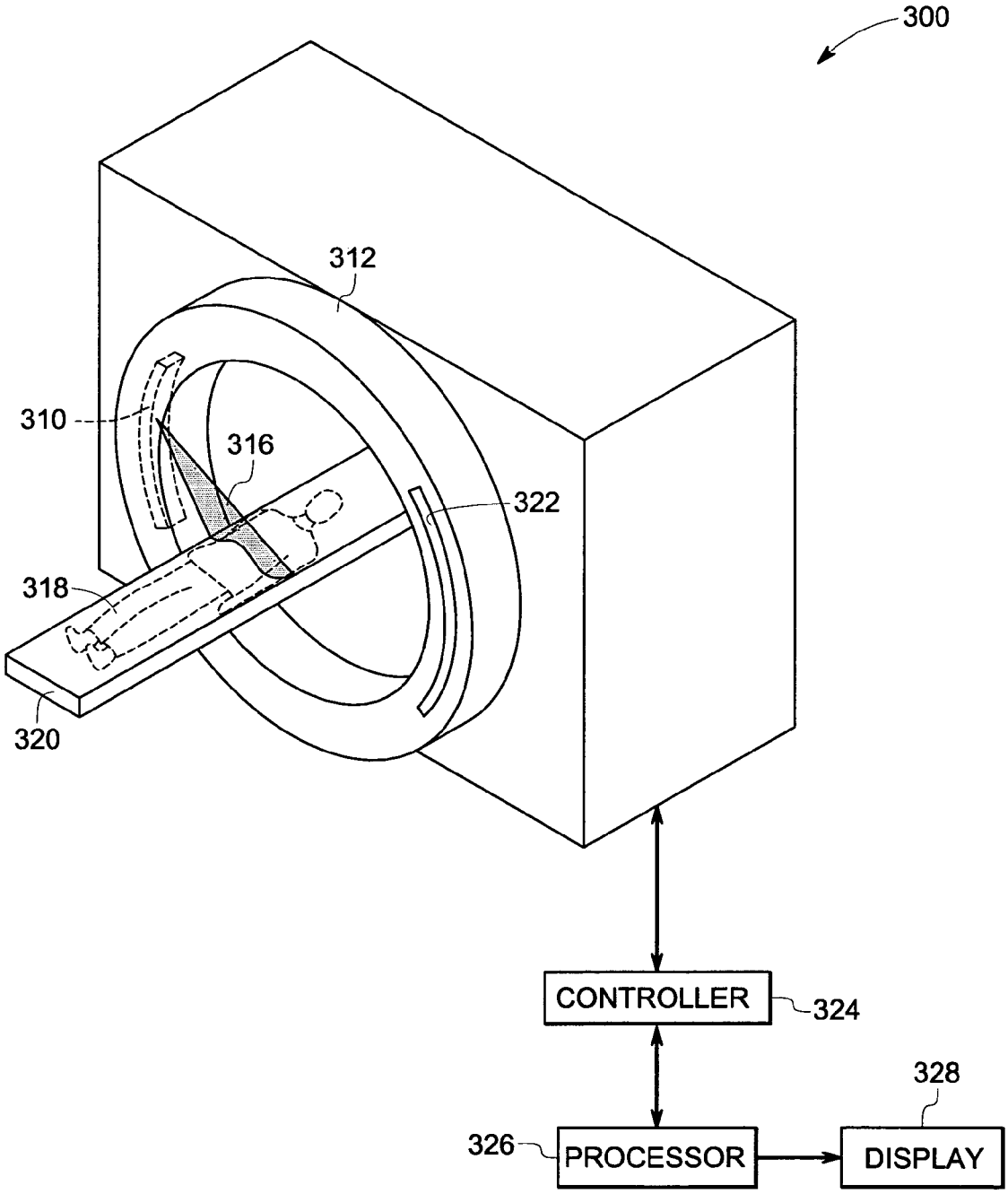
FIG. 4 is a schematic representation of an embodiment of an X-ray imaging system.

Referring to FIG. 4, in the illustrated embodiment, system 300 is a computed tomography (CT) system designed to acquire original image data, and to process the image data for display and analysis. In the embodiment illustrated in FIG. 4, imaging system 300 includes a cascaded CS source of X-ray radiation 310 positioned inside a rotary unit called gantry 312 adjacent to a collimator. The Collimator permits a stream of radiation 316 to pass into a region in which an object 318 is positioned on a table 320. A portion of the radiation 316 passes through or around the object 318 and impacts a detector array 322. A controller 324 controls the X-ray source and the gantry. Detector elements of the array produce electrical signals that represent the intensity of the incident X-ray beam. These signals are acquired and processed using a processor 326 to reconstruct an image of the features within the object and displayed on a display 328.

The imaging system may comprise a conventional radiographic imaging system or a phase contrast imaging system, for example. Phase contrast imaging is desirable for imaging and delineating structures such as soft-tissues that do not appreciably absorb X-rays and may contain non-absorptive structural details. For such structures, quasi-coherent X-rays with tight beam spots are desirable. Phase contrast imaging is a technique that captures the refractive index variations in a non-absorbing object. Refractive index variations cause phase shift of the X-ray photons as they traverse the object and are characterized by deviations from the incident beam path. The shift is typically measured using a detector.

A further embodiment is a mammography system. It is desirable to use low dosage and monochromatic X-rays to visualize breast tissue. The image of the breast (including any abnormalities) results from some of the X-rays being absorbed while others pass though the breast to expose a film. Cancerous breast tissues exhibit higher linear attenuation characteristics than do normal tissues, when studied with monochromatic X-rays, thereby providing better contrast images.

Another embodiment is a vascular imaging system such as an X-ray angiographic system. X-ray angiography is typically performed to image and diagnose diseases of the blood vessels of the body, including the brain, arteries carrying blood to the brain, arteries and veins in the extremities, and heart.

In a further embodiment is an X-ray fluoroscopy imaging system. Fluoroscopy is an enhanced form of diagnostic radiology that enables the radiologist to visualize the organ or area of concern by using X-rays. Fluoroscopy uses X-rays, and sometimes a contrast agent to image inner parts of the body such as the digestive tract, kidneys, and gallbladder in motion. The body's soft tissue organs, such as the stomach, liver, and intestines have a density which gives an external outline but does not show the inner parts of these structures. This problem is typically solved in "hollow" organs such as the stomach and the intestines by introducing a contrast material such as barium, which can be swallowed or given as an enema. Some contrast media contain iodine solutions, for example, which enhance X-ray absorption in blood vessels or kidneys enabling those structures to be seen on film or video for later review using techniques like digital image subtraction.

In another embodiment, a non-destructive imaging system. Non-destructive imaging is used to detect defects in manufactured products such as automotive parts. In still another embodiment an X-ray crystallography system is used to exploit the fact that X-rays are diffracted by crystals. X-rays have the appropriate wavelength (in the Angstrom range, ~$10^{-8}$ cm) to be scattered by the electron cloud of an atom of comparable size. Based on the diffraction pattern obtained from X-ray scattering off the periodic assembly of molecules or atoms in the crystal, the electron density can be reconstructed.

TABLE 1 illustrates results of first principle calculation of wavelength and energy values of inverse Compton scattered photons.

| λ(micron) | Eλ(MeV) | $E_{ICS}$(keV) | $\lambda_{ICS}$[micron] |
|---|---|---|---|
| 1 | 1 | 0.019 | 6.54E−02 |
| 1 | 2 | 0.076 | 1.64E−02 |
| 1 | 3 | 0.171 | 7.27E−03 |
| 1 | 4 | 0.304 | 4.09E−03 |
| 4.09E−03 | 1 | 4.64548 | 2.68E−04 |
| 4.09E−03 | 2 | 18.5819 | 6.69E−05 |
| 4.09E−03 | 3 | 41.8093 | 2.97E−05 |
| 4.09E−03 | 4 | 74.3276 | 1.67E−05 |
| 7.27E−03 | 1 | 2.61348 | 4.76E−04 |
| 7.27E−03 | 2 | 10.4539 | 1.19E−04 |
| 7.27E−03 | 3 | 23.5213 | 5.28E−05 |
| 7.27E−03 | 4 | 41.8157 | 2.97E−05 |

EXAMPLE 1

In one example, a laser source lasing at 1 micron pumps an optical resonator which comprises an interaction chamber through which a 3 MeV electron beam passes. The photons in the laser beam are inverse Compton scattered to produce photons at about 7.2 nm wavelength. The 7.2 nm photons are then directed towards a second interaction chamber where they scatter off another 3 MeV electron beam. As a result of this second ICS process, the photons gain additional energy resulting in hard X-rays with energy of about 24 keV.

EXAMPLE 2

In another example, a laser source lasing at 1 micron pumps an optical resonator which comprises an interaction chamber through which a 4 MeV electron beam passes. The photons in the laser beam are inverse Compton scattered to produce photons at about 4 nm wavelength. The 4 nm photons are then directed towards a second interaction chamber where they scatter off another 2 MeV electron beam. As a result of this second ICS process, the photons gain additional energy resulting in hard X-rays with energy of about 10 keV.

The previously described embodiments of the present invention have many advantages, especially the elimination of the large electron accelerator modules. This enables the use of lower energy electrons available directly from RF photoinjector sources, which can be built of modest size, even less than one-half meter, allowing for a compact tube-like structured cascaded ICS X-ray generation system.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A cascaded inverse Compton scattering (ICS) system for generating an X-ray pulse comprising:

a first electron beam source configured to direct a first electron pulse of predetermined energy and pulse length towards a first interaction zone;

a laser beam source configured to direct a first photon pulse of predetermined energy and pulse length towards the first interaction zone to interact with the first electron pulse, so that the first interaction produces a second photon pulse of higher photon energy directed towards a second interaction zone; and a second electron beam source configured to direct a second electron pulse of predetermined energy and pulse length towards the second interaction zone so that the second interaction produces an X-ray pulse of predetermined energy and pulse length in a cascaded ICS configuration.

2. The system of claim 1, wherein the first electron beam source and the second electron beam source comprise first and second RF photoinjector sources.

3. The system of claim 2, wherein each of the first and second RF photoinjector sources is configured for being photointiated by a frequency up-converted output of the laser beam source.

4. The system of claim 1, wherein the laser beam source is located remotely with respect to the first interaction zone and the second interaction zone.

5. The system of claim 1, wherein the energy and pulse length of the first electron pulse and second electron are independently configured.

6. The system of claim 1, wherein the X-ray pulse is substantially monochromatic.

7. The system of claim 1, wherein the energy of the X-ray pulse is tunable.

8. The system of claim 1, wherein the predetermined energy of the X-ray pulse is within a range of 10 keV to 50 keV.

9. The system of claim 1, wherein the predetermined length of the X-ray pulse is within a range of 10 fs to 300 ps.

10. The system of claim 1, wherein the X-ray pulse has a flux density within a range of $1\times10^{6}$ photons/pulse to $1\times10^{16}$ photons/pulse.

11. The system of claim 1, wherein the X-ray pulse has an initial spot size diameter within a range of 25 microns to 100 microns.

12. The system of claim 1, further comprising electron-focusing elements configured to focus the first electron pulse and the second electron pulse.

13. The system of claim 1, further comprising photon-focusing elements configured to focus the first photon pulse and the second photon pulse.

14. The system of claim 1, further comprising a synchronization controller configured to temporally synchronize the first electron pulse, the second electron pulse and the first photon pulse.

15. The system of claim 1, wherein the laser beam source comprises at least one selected from the group consisting of Nd:YAG, Yb:YAG, Ho:YAG, Ti:Sapphire, Er:glass, Er:YAG, and Cr:Forsterite laser.

16. An imaging system comprising:

a first electron beam source of the imaging system configured to direct a first electron pulse of predetermined energy and pulse length towards a first interaction zone;

a laser beam source configured to direct a first photon pulse of predetermined energy and pulse length towards the first interaction zone to interact with the first electron pulse so that the interaction produces a substantially monochromatic second photon pulse of higher photon energy directed towards a second interaction zone; and a second electron beam source of the imaging system configured to direct a second electron pulse of predetermined energy and pulse length towards the second interaction zone so that the interaction produces a substantially monochromatic X-ray pulse of predetermined energy and pulse length in a cascaded inverse Compton scattering (ICS) configuration.

17. The imaging system of claim 16, wherein the imaging system is configured for use as a non-destructive X-ray imaging system.

18. The imaging system of claim 16, wherein the imaging system is configured for use as a system selected from the group consisting of radiography, fluoroscopy, computerized tomography, mammography, cardiac angiography, phase contrast imaging, and X-ray crystallography systems.

19. The imaging system of claim 16, wherein the imaging system is configured for use as a computerized tomography system.

20. The imaging system of claim 19, further comprising a rotary unit configured to rotate integrally around a person or object to be imaged, wherein the second interaction zone is situated within the rotary unit, and further comprising an X-ray detector.

21. The imaging system of claim 20, wherein the laser beam source is located remotely with respect to the rotary unit.

22. A method of generating an X-ray pulse of tunable energy comprising the steps of:

generating a first photon pulse;

generating a first electron pulse substantially synchronously with the first photon pulse;

inverse Compton scattering the first electron pulse off the first photon pulse in a first interaction zone to produce a second photon pulse, wherein the photons in the second photon pulse have a higher energy than the photons in the first photon pulse;

generating a second electron pulse; and inverse Compton scattering the second electron pulse with the second photon pulse in a second interaction zone to produce a pulse of substantially monochromatic X-ray photons.

23. The method of claim 22, wherein the first photon pulse and first electron pulse collide substantially collinearly.

24. The method of claim 22, wherein the second photon pulse and second electron pulse collide substantially collinearly.

* * * * *